US005087887A

United States Patent [19]

Kawakami

[11] Patent Number: 5,087,887

[45] Date of Patent: Feb. 11, 1992

[54] STANDING WAVE TYPE LINEAR ACCELERATOR

[75] Inventor: Hideyuki Kawakami, Hyogo, Japan

[73] Assignee: Mitsubishi Denki Kabushiki Kaisha, Tokyo, Japan

[21] Appl. No.: 596,447

[22] Filed: Oct. 12, 1990

[30] Foreign Application Priority Data

May 31, 1990 [JP] Japan ..... 2-140026

[51] Int. Cl.[5] ..... H01J 23/34

[52] U.S. Cl. ..... 328/233

[58] Field of Search ..... 328/227, 233

[56] References Cited

U.S. PATENT DOCUMENTS 3,638,127 1/1972 Kerns ..... 328/227

4,982,320 1/1991 Eaton et al. ..... 328/233 X

FOREIGN PATENT DOCUMENTS 53-117198 10/1978 Japan .

*Primary Examiner*—Sandra L. O'Shea

*Attorney, Agent, or Firm*—Rothwell, Figg, Ernst & Kurz

[57] ABSTRACT

In the standing wave type linear accelerator according to this invention, a phase difference signal output from a differential amplifier is sample-held after it is integrated, allowing a stable control signal to be obtained, by which it is unnecessary to increase the gain of the differential amplifier and to adjust the offset of the same, and the probability of faulty operation of the control circuit is lowered. Further, an interlock signal generator is provided, allowing the accelerator to be stopped in the case of occurrence of the faulty operation.

2 Claims, 4 Drawing Sheets

STANDING WAVE TYPE LINEAR ACCELERATOR

BACKGROUND OF THE INVENTION

1. Field of the Invention

This invention relates to a standing wave type linear accelerator, and particularly to its high frequency power automatic frequency control.

2. Description of the Prior Art

FIG. 1 is a block diagram of a conventional high frequency power automatic frequency controller of a standing wave type linear accelerator shown in, for example, Japanese Patent Laid-open No. 53-117198. In FIG. 1, reference numeral 1 is a high frequency generator which generates high frequency power, 2 a waveguide connected to the output side of the high frequency generator 1 for conducting the high frequency power generated, 3 a circulator connected to the output side of the waveguide 2 for conducting the high frequency power, 4 an electron gun for generating electrons, 5 a standing wave type linear accelerating tube interconnected to the circulator 3 for accelerating electrons from the electron gun 4, 6 is a water load connected to the output side of the circulator 3 for absorbing the high frequency power reflected from the accelerating tube 5 via the circulator 3, 7a an attenuator inserted into the output side of the waveguide 2 if necessary, 7b an attenuator inserted into the output side of a coupling portion between the circulator 3 and the water load 6, 8 a delay line connected via the attenuator 7a to the waveguide 2 for delaying the incident high frequency power, 9 a variable phase shifter for changing a phase of the incident high frequency power in the output side of the delay line 8, 10 a hybrid ring, that is, a high frequency mixer connected to the variable phase shifter 9 and at the same time, connected via the attenuator 7b to the circulator 3, 11a and 11b are high frequency diodes connected to respective output terminals of the hybrid ring 10, 12a and 12b are attenuators connected to the high frequency diodes 11a and 11b if necessary, respectively, 13 a differential amplifier whose input terminals are connected to the attenuators 12a and 12b, respectively, and 14 a servomotor connected across output terminals of the differential amplifier 13 for mechanically adjusting an oscillation frequency of the high frequency generator 1.

A conventional high frequency power automatic frequency controller is constituted as described above, and hereinafter the operation thereof will be described. The high frequency power $\dot{V}_o$ generated by the high frequency generator 1 is supplied to the accelerating tube 5 via the waveguide 2 and the circulator 3 for incidence. The high frequency power reflected by the accelerating tube 5 is conducted to the water load 6 via the circulator 3 and absorbed therein. One part of the high frequency power $\dot{V}_o$ is extracted by the waveguide 2 and conducted via the delay line 8 and the variable phase shifter 9 to the hybrid ring 10 as an incident high frequency power $\dot{V}_I$. One part of the reflected high frequency power from the accelerating tube 5 is taken out from the coupling portion between the circulator 3 and the water load 6 and sent to the hybrid ring 10 as a reflected high frequency power $\dot{V}_R$. The incident high frequency power $\dot{V}_I$ and the reflected high frequency power $\dot{V}_R$ are mixed in the form of a vector by the hybrid ring 10. The outputs $\dot{V}_1$ and $\dot{V}_2$ are respectively detected by the high frequency diodes 11a and 11b and input via the attenuators 12a and 12b to the differential amplifier 13. An output $|\dot{V}_1|-|\dot{V}_2|$ of the differential amplifier 13 corresponds to a shift in frequency $\Delta fo$ between the incident and reflected high frequency power $\dot{V}_I$ and $\dot{V}_R$, that is, a phase shift $\Delta\phi_o$ and adjusts a tuner (not shown) of the high frequency generator 1 by giving normal rotation or reverse rotation to the servomotor 14 in accordance with the polarity of the phase shift, allowing the oscillation frequency to be controlled. The correspondence of the polarity of the output $|\dot{V}_1|-|\dot{V}_2|$ to the polarity of the phase shift $\Delta\phi_o$ between the incident high frequency power and the reflected high frequency power will be described below. Hereinafter, necessary constants and so forth are omitted for the sake of convenience in order to describe the correspondence while paying attention to the phase shift $\Delta\phi_o$. In the constitution shown in FIG. 3, when the frequency of the high frequency power $\dot{V}_o$ is equal to an optimal acceleration frequency fo of the accelerating tube 5, the reflected high frequency power $\dot{V}_R$ is behind the incident high frequency power $\dot{V}_I$ by $\pi/2$ radians. Accordingly, the delay in phase of the reflected high frequency power $\dot{V}_R$ at the time when the frequency of the high frequency power $\dot{V}_o$ is $fo+\Delta fo$ can be represented by $\pi/2+\Delta\phi_o$. Where, in this case, $\Delta\phi_o$ is in a range of $-\pi/2<\Delta\phi_o<\pi/2$. Accordingly, when the phase of the high frequency power $\dot{V}_o$ is made to delay by $\pi/2$ radians by adjusting the delay line 8 and the variable phase shifter 9, the relation between the high frequency power $\dot{V}_o$, and high frequency power inputs $\dot{V}_I$ and $\dot{V}_R$ of the hybrid ring 10 can be represented as follows.

$$\dot{V}_O = V_O\, e^{j(\omega t+\frac{\pi}{2})} \tag{1}$$

$$\dot{V}_I = V_I\, e^{j\omega t} \tag{2}$$

$$\dot{V}_R = V_R\, e^{j(\omega t-\Delta\phi_o)} \tag{3}$$

where $\dot{V}_o$, $\dot{V}_I$, and $\dot{V}_R$ are amplitudes, $\omega$ is an angular frequency of the high frequency power, and t is time).

Accordingly, from the characteristics of the hybrid ring 10 the $\dot{V}_1$ and $\dot{V}_2$ are represented as follows.

$$\dot{V}_1 = \frac{V_I}{\sqrt{2}}\, e^{j\omega t} + \frac{V_R}{\sqrt{2}}\, e^{j(\omega t-\Delta\phi_o-\frac{\pi}{2})} \tag{4}$$

$$\dot{V}_2 = \frac{V_I}{\sqrt{2}}\, e^{j(\omega t-\frac{\pi}{2})} + \frac{V_R}{\sqrt{2}}\, e^{j(\omega t-\Delta\phi_o)} \tag{5}$$

When these high frequency powers are detected by the high frequency diodes 11a and 11b, the outputs become the absolute values of the expressions (4) and (5). Accordingly, they are represented as follows.

$$|\dot{V}_1| = \frac{V_I}{\sqrt{2}}\sqrt{1+\left(\frac{V_R}{V_I}\right)^2-\frac{2V_R}{V_I}\sin(\Delta\phi_o)} \tag{6}$$

$$|\dot{V}_2| = \frac{V_I}{\sqrt{2}}\sqrt{1+\left(\frac{V_R}{V_I}\right)^2+\frac{2V_R}{V_I}\sin(\Delta\phi_o)} \tag{7}$$

Since $|\dot{V}_1|>0$ and $|\dot{V}_2|>0$, and the polarity of $|\dot{V}_1|-|\dot{V}_2|$ is same as that of $|\dot{V}_1|^2-|\dot{V}_2|^2$, the following expression holds.

$$|\dot{V}_1|^2-|V_2|^2=-2V_I V_R \sin(\Delta\phi_o) \quad (8)$$

Accordingly, it is found that the following expressions hold from the expression (8).

when $\pi/2 > \Delta\phi_o > 0$, $|\dot{V}_1| - |\dot{V}_2| < 0$ when $\Delta\phi_o = 0$, $|\dot{V}_1| - |\dot{V}_2| = 0$ when $0 > \Delta\phi_o > -\pi/2$ $|\dot{V}_1| - |\dot{V}_2| > 0$ As described above, the phase of the reflected high frequency power from the accelerating tube 5 is detected to apply negative feedback to the high frequency generator 1 and make the oscillation frequency of the high frequency power follow the variation of the optimal acceleration frequency of the accelerating tube 5 due to temperature changes. Incidentally, in general, a linear accelerator utilizing a high frequency adopts a pulse operation system, and its high frequency output and its output beam both have a pulse waveform. FIG. 2 is a diagram showing a high frequency input detected waveform of the differential amplifier 13 at the terminals (a) and (b) in FIG. 1. $V_{P1}$ and $V_{P2}$ each show a pulse height, and $\tau_1$ and $\tau_2$ each show a pulth width, T shows a pulse repetitive interval time, and $V_{av1}$ and $V_{av2}$ each show a voltage value obtained by integrating a pulse and averaging the integrated value. Incidentally, $V_{av1}$ and $V_{av2}$ are represented by the following expressions (9) and (10).

$$V_{av1} = \frac{V_{P1} \cdot \tau_1}{T} \quad (9)$$

$$V_{av2} = \frac{V_{P2} \cdot \tau_2}{T} \quad (10)$$

Usually, the frequency control using a pulse operation system drives the servomotor 14 in such a manner that the differential output $V_{av1}-V_{av2}$ of values $V_{av1}$ and $V_{av2}$ obtained by averaging pulse output waveforms becomes zero.

Since a conventional high frequency power automatic frequency controller uses a signal obtained by averaging a high frequency output detected waveform and the level of the averaged signal is small, the amplification factor of the differential amplifier is made large to drive the servomotor. Accordingly, there are problems that the offset adjustment for the differential amplifier is necessary, and the control circuit is prone to operate faultily due to drifts and noises caused by temperature changes. Even in the case where the control circuit operates faultily and the frequency is far away from the optimal acceleration condition, there are problems that the conventional high frequency power automatic frequency controller has not the function of stopping the operation of the controller, energy of the output beam is largely lowered, and the controller is in danger of continuing to be operated in a state in which no output beam can be obtained.

SUMMARY OF THE INVENTION

This invention is devised in order to solve such problems as described above, and is an object thereof to obtain a standing wave type accelerator which raises the level of an output signal for control to operate its control circuit steadily.

It is also an object of this invention to obtain a standing wave type accelerator which, if detects the accelerating frequency for an accelerating tube deviating from the optimal accelerating condition, stops the operation thereof.

In order to attain the above-mentioned objects, the standing wave type linear accelerator according to this invention comprises: an integration and sample-hold means which integrates and sample-holds a phase difference signal of a differential amplifier; and a feedback means which feeds back the output of the integration and sample-hold means to a high frequency generator.

Also, the standing wave type linear accelerator according to this invention further comprises an interlock signal generation means which generates an interlock signal for stopping the operation of the accelerator when an oscillation frequency of the high frequency generator deviates widely from the optimal accelerating frequency for the accelerating tube The above-mentioned objects, the other objects, and new features of this invention will be more perfectly apparent if the following detailed description is read with reference to accompanying drawings.

DETAILED DESCRIPTION OF THE PREFERRED EMBODIMENTS

Hereinafter, an embodiment according to this invention will be described with reference to drawings.

Figure 3:
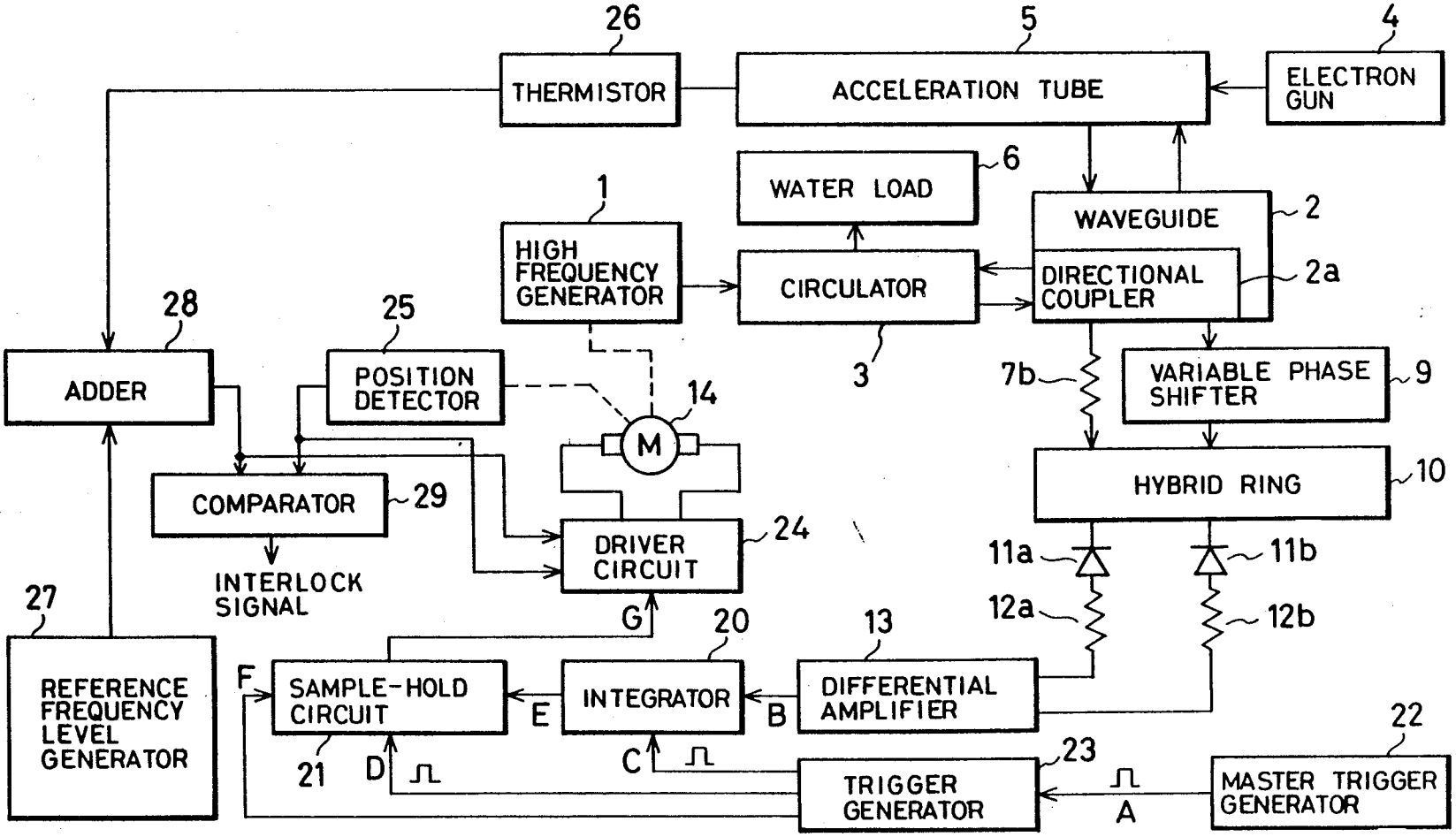
FIG. 3 is a block diagram showing an embodiment according to this invention.

FIG. 3 is a block diagram showing an embodiment related to this invention. In FIG. 3, since reference numerals 1 to 6, 7*b*, and 9 to 14 are same as those in the conventional accelerator, their description is omitted.

Reference numeral 2*a* is a means which is provided in a waveguide 2 for conducting high frequency power to take out one part of each of an incident wave and a reflected wave of the high frequency power, for example, a directional coupler, 20 an analog integrator provided in the output side of a differential amplifier 13, and 21 a sample-hold circuit provided in the output side of the integrator 20 and constitutes an integration and sample-hold means together with the integrator 20. Reference numeral 22 is a master-trigger generator and 23 is a trigger generator which operates using the master-trigger generator 22 as an outside trigger, and its output side is connected to the integrator 20 and the input side of the sample-hold circuit 21. Reference numeral 24 is a driver circuit which is inserted between the sample-hold circuit 21 and the servomotor 14, and constitutes a feedback means together with the servomotor 14. Reference numeral 25 is a position detector which is provided on a rotary shaft of the servomotor 14 to detect the position of the servomotor 14, for example, a potentiometer, 26 a thermister which is close contacted with a case of an accelerating tube 5 to detect temperature, 27 a reference frequency level generator, for example, a potentiometer, 28 an adder which adds a temperature signal of the thermister 26 to a reference frequency signal of the reference frequency level generator 27, and 29 a comparator which compares a frequency monitoring position signal of the position detector 25 with a corrected reference frequency signal from the adder 28 for generating an interlock signal. Incidentally, the position signal of the position detector 25 and the corrected reference frequency signal are also supplied to the driver circuit 24. Also, reference numerals 25 to 29 constitute an interlock signal generation means.

Figure 4:
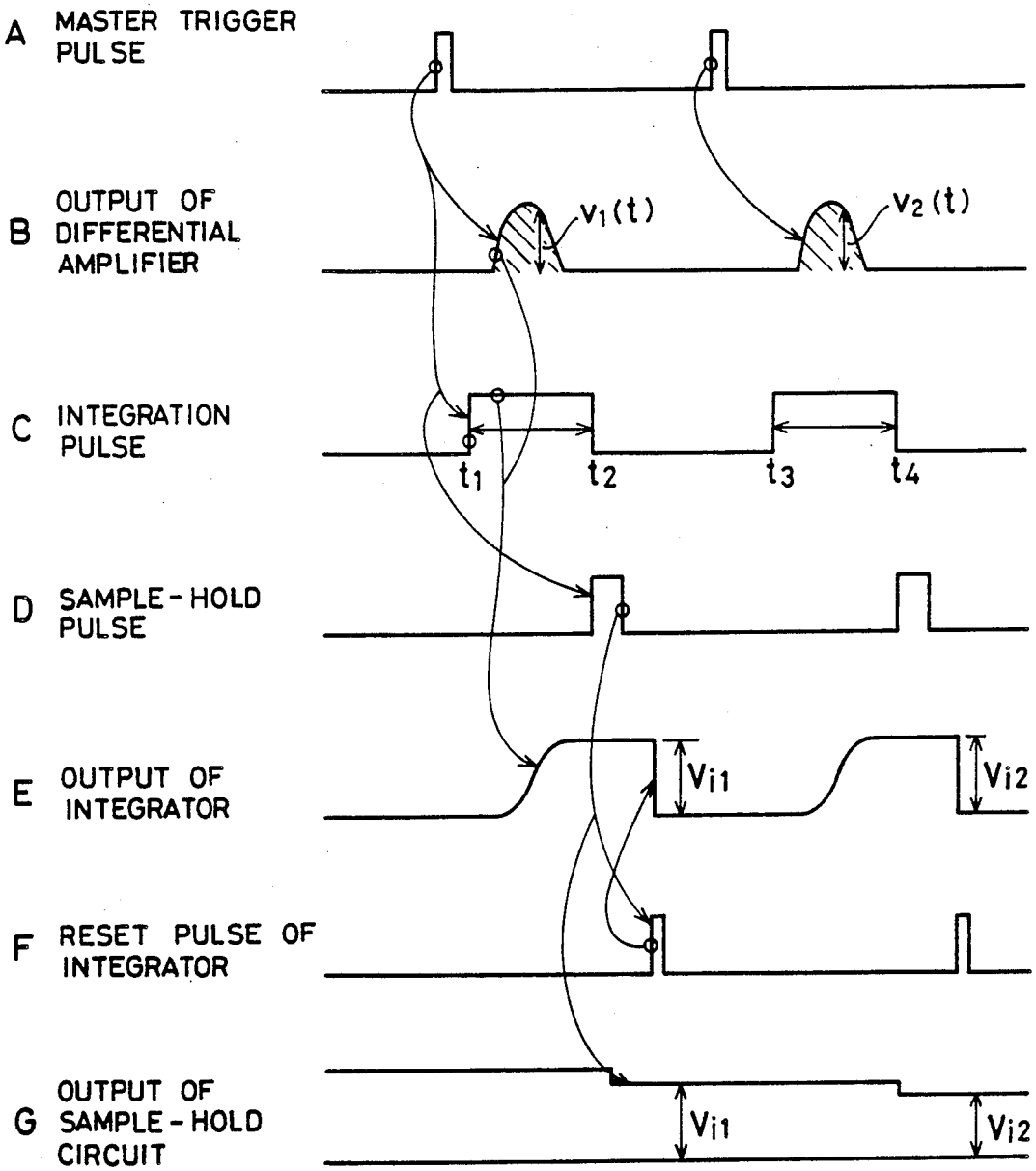
FIG. 4 is a time chart diagram explanatory of the operation of the embodiment shown in FIG. 3.

FIG. 4 is a time chart diagram explanatory of the operation of the embodiment shown in FIG. 3. The master-trigger generator 22 generates a master-trigger pulse A, and the high frequency generator 1 also generates the high frequency power in synchronism with the master-trigger pulse A The differential amplifier 13 generates an output B, and the output B shows a phase shift between the incident high frequency power and the reflected high frequency power, that is, a shift in frequency from the optimal accelerating frequency of the accelerating tube 5. The triffer generator 23 generates an integration pulse C behind the trigger pulse A, and while the integration pulse C is in a H (high) level, the integrator 20 integrates the output B of the differential amplifier 13. Incidentally, here a timing is set up so as to integrate the whole of the output B of the differential amplifier 13, and $V_{i1}$ and $V_{i2}$ of the output E of the integrator 20 become such values as represented by the following expression (11).

$$\left.\begin{aligned} V_{i1} &= \int_{t_1}^{t_2} v_1(t)dt \\ V_{i2} &= \int_{t_3}^{t_4} v_2(t)dt \end{aligned}\right\} \quad (11)$$

It is necessary to hold the output E after integration until the next output B of the differential amplifier is integrated. The output E is held in the sample-hold circuit 21 at the timing of the sample-hold pulse D from the trigger generator 23, and then converted into DC components. The sample-hold circuit 21 is reset to zero at the timing of the reset pulse F in such a manner that the output E of the integrator 20 is not integrated repeatedly when the next output B of the differential amplifier is integrated. The signals $V_{i1}$ and $V_{i2}$ of the integrator E are held by the sample-hold circuit 21 to be converted into DC components in such a manner that the output E of the integrator goes toward the direction of a zero level, and the output G of the sample-hold circuit 21 is supplied to the driver circuit 24. The driver circuit 24 drives the servomotor 14 in such a manner that the accelerating tube 5 is accelerated at the optimal accelerating frequency. Incidentally, when the polarity of the output G of the sample-hold circuit 21 is negative, the servomotor 14 is rotated in the direction reverse to that of the rotation at the time of the output G being positive.

Figure 1:
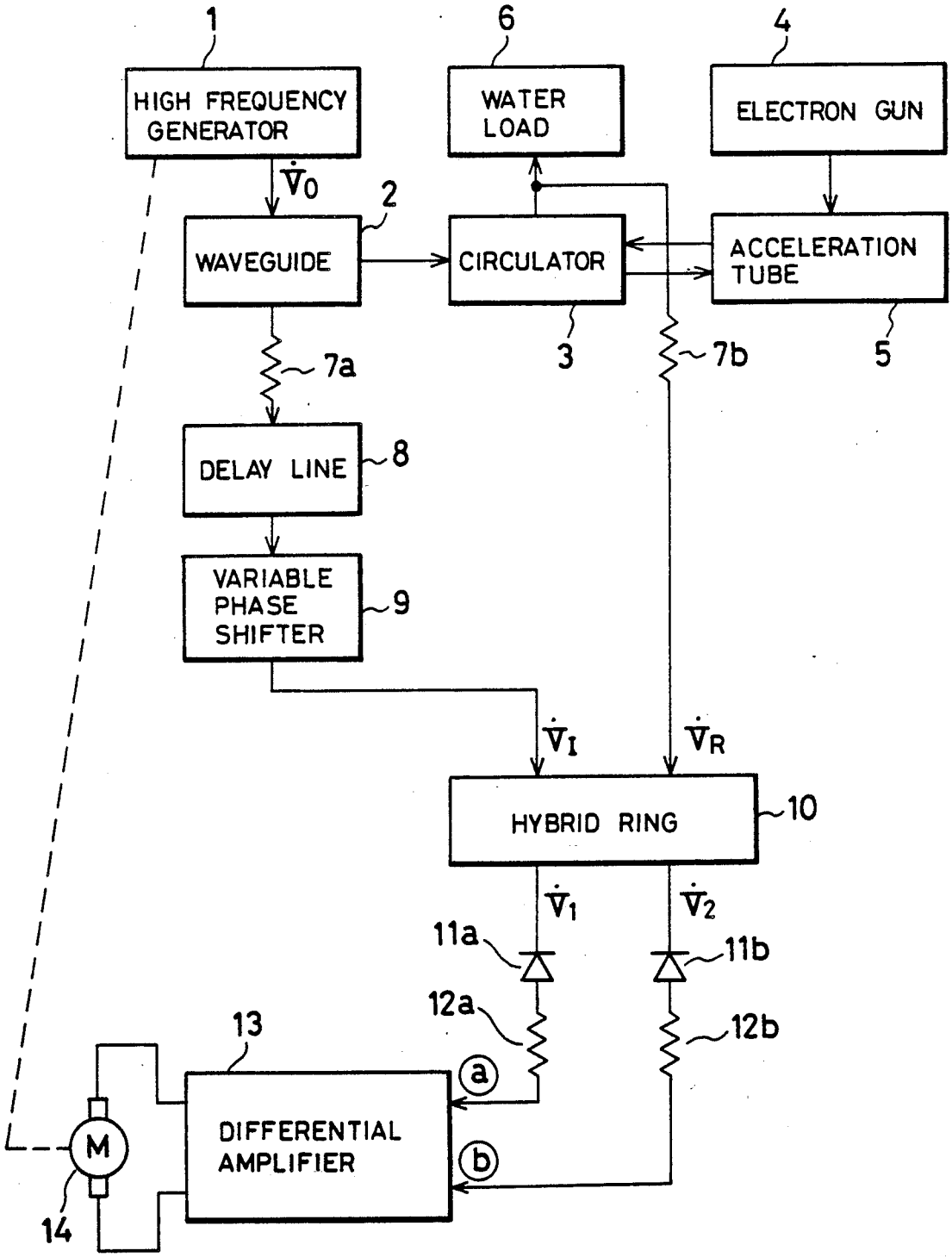
FIG. 1 (PRIOR ART)
FIG. 1 is a block diagram showing a conventional high frequency power automatic frequency controller.
Figure 2A:
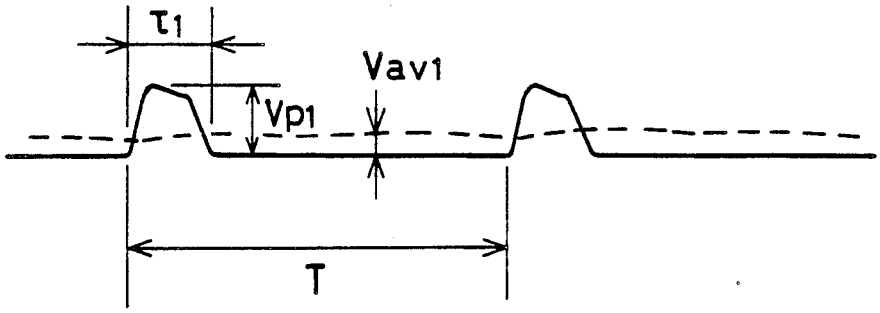
FIG. 2a (PRIOR ART)
FIG. 2A and 2B are a time chart diagram of waveforms explanatory of the operation of the conventional accelerator.
Figure 2B:
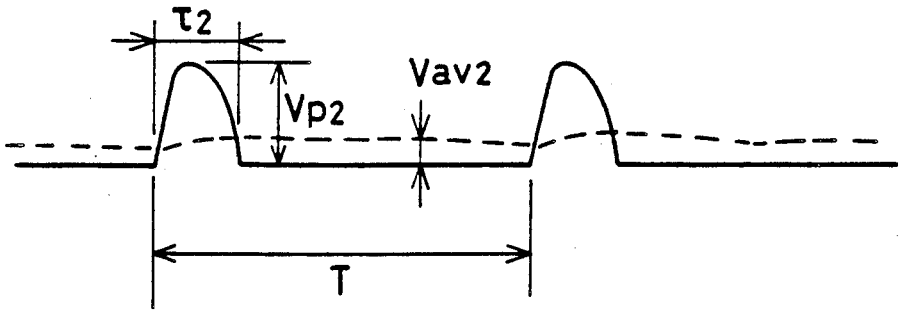
FIG. 2b (PRIOR ART)

Usually, though the conventional linear accelerator is not shown in FIG. 1, it is provided with a reference frequency level generator 27. Based on the reference frequency signal from the reference frequency level generator 27, the driver circuit 24 sets up the oscillation frequency of the high frequency generator 1. By the way, it is generally known that the optimal accelerating frequency shifts due to temperature by $-\Delta f$/deg in the conventional linear accelerator. Accordingly, it is necessary to compensate a frequency shift due to the temperature change of the accelerating tube 5 for the reference frequency signal and set up the reference frequency.

Then, in this invention, the reference frequency signal is compensated by closely contacting the thermister 26 with the case of the accelerating tube 5 and adding the temperature signal from the thermister 26 to the reference frequency signal in the adder 28, and the corrected reference frequency signal is sent to the driver circuit 24 to set up the oscillation frequency of the high frequency generator 1 using the corrected reference frequency signal. On the other hand, the corrected reference frequency signal is sent to the comparator 29 to be compared with the position signal from the position detector 25. Usually, when the high frequency power automatic frequency controller is operate normally, the oscillation frequency of the high frequency generator 1 is subjected to follow up-control so as to always coincide with the optimal acceleration frequency. But sometimes the oscillation frequency of the high frequency generator 1 is largely shifted from the optimal accelerating frequency of the accelerating tube 5 by damages of circuit components or a faulty operation of the automatic frequency controller due to noises. Then, in this invention, the reference frequency signal which the adder 28 has corrected and the position signal of the position detector 25 have been adjusted so as to coincide with each other at the optimal acceleration, and a signal difference between the both signals is generated when the reference frequency shift from the optimal accelerating frequency as described above. The comparator 29 monitors the corrected reference frequency signal and the position signal, and generates an interlock signal when the difference between the both signals exceeds an allowable value, allowing the operation of the linear accelerator to be stopped.

As described above, since the linear accelerator according to this invention provides an integration and sample-hold means which integrates the phase difference signal of the differential amplifier and sample-holds it, and a feedback means which feeds back the output of the integration and sample-hold means to the high frequency generator, there are obtained the effets that it is possible to operate the linear accelerator by lowering the gain of the control circuit and assure its steady operation.

Further, the linear accelerator according to this invention provides an interlock signal generation means, allowing its operation to be stopped at the time of its abnormal operation.

But, the drawings are exclusively for the explanation, they do not limit the scope of this invention.

What is claimed is:

1. A standing wave type linear accelerator comprising:

a high frequency generator which generates high frequency power;

a standing wave type accelerating tube on which the generated high frequency power is incident and from which the same is reflected;

a means which is disposed between the high frequency generator and the accelerating tube to take out one part of each of the incident high frequency power and the reflected high frequency power;

a variable phase shifter which changes a phase of either one of the both parts of the incident and reflected high frequency power;

a high frequency mixer which mixes the phase-shifted one part with the other part of the incident and reflected high frequency power;

a differential amplifier which generates a signal showing a phase difference between the incident and reflected high frequency power based on an output from the high frequency mixer;

an integration and sample-hold means which integrates the phase difference signal and sample-holds the same; and a feedback means which feeds back an output of the integration and sample-hold means to said high frequency generator to perform follow-up control so as to make an oscillation frequency of said high frequency generator coincide with an optimal accelerating frequency of said acceleration tube.

2. The standing wave type linear accelerator according to claim 1, further comprising: an interlock signal generation means, upon comparing a corrected reference frequency signal with a position signal from said feedback means, for generating an interlock signal when a difference between the both signals exceeds a predetermined range; said corrected reference frequency signal, being obtained by adding a signal showing a temperature of the standing wave type accelerating tube to a reference frequency signal, for determining the oscillation frequency of said high frequency generator; said position signal for monitoring the oscillation frequency of said high frequency generator, whereby the follow-up control of the oscillation frequency is carried out so as to make the same coincide with the optimal accelerating frequency of said accelerating tube.

* * * * *